United States Patent [19]

Confer et al.

[11] 4,067,614

[45] Jan. 10, 1978

[54] FOOTSTOOL

[75] Inventors: Raymond C. Confer, Gasport; Thomas F. Gosch, Amherst, both of N.Y.

[73] Assignees: Raymond C. Confer; Thomas F. Gosch; John W. Gatke, all of Buffalo, N.Y. ; part interest to each

[21] Appl. No.: 731,638

[22] Filed: Oct. 12, 1976

[51] Int. Cl.[2] ..... A47C 9/12

[52] U.S. Cl. ..... 297/438

[58] Field of Search ..... 5/327 R, 327 B; 297/438, 439

[56] References Cited

U.S. PATENT DOCUMENTS 2,615,503 10/1952 Enge ..... 297/438

*Primary Examiner*—James C. Mitchell

*Attorney, Agent, or Firm*—Sommer & Sommer

[57] ABSTRACT

A footstool includes a vertical base member having a lower end arranged to rest on a floor, and a support member mounted on the base member and extending outwardly therefrom to support the legs and feet of a user. The base member has two openings therethrough, and first and second surfaces arranged to face toward and away from the support member. The support member includes two male members arranged to penetrate the base member openings, and has a first surface arranged to abut the base member first surface. Each male member carries a hook-like member which is adapted to engage the base member second surface to prevent unintended separation of the base and support members.

5 Claims, 5 Drawing Figures

3
F
21
15
2
L
20
22
13
42
43
12
18
34
41
38
37
11
39
23
10
16

10
19
20
21
41
42
40
12
54
15
14
13
43
34
38
37
11
39

11
15
21
20
14
13
4
54
18
16

10
42
39
34
41
38
35
26
29
50
44
31
11
14
13
51
48
57
52
55
53
54
56
49
32
28
30
12

11
22
13
14
33
45
24
36
34
57
52
54
50
53
48
51
5
55
56
58
25
46
44
21
18
12
41
39
42

FOOTSTOOL

BACKGROUND OF THE INVENTION

1. Field of the Invention

The present invention relates generally to a footstool, and more particularly to an improved footstool wherein a support member is uniquely connected to a perpendicular base member.

2. Description of the Prior Art

Many variations and embodiments of footstools are, of course, known.

One unique type of footstool has a substantially horizontal support member extending outwardly from a substantially vertical base member. In one design, the support member is mounted on the base member at a position other than midway between its end so that the footstool may simply be turned over to vary the operative height of the support member.

SUMMARY OF THE INVENTION

The present invention provides an improved footstool which broadly comprises: a base member having upper and lower ends, at least one of these ends being adapted to rest on a floor; and a support member having one marginal end portion mounted on the base member at a position between the upper and lower base member ends, this support member extending outwardly from the base member and adapted to support the leg and foot of a user. The base member has at least one opening therethrough, a first surface arrange to face toward the support member, and a second surface about the opening spaced from the first surface and arranged to face away from the support member. The support member has at least one male member extending outwardly therefrom and arranged to penetrate the base member opening, a first surface arranged to abut the base member first surface, and at least one catch means carried by the male member and arranged to operatively engage the base member second surface to prevent unintended separation of the support member from the base member.

In a preferred embodiment, the male member is an open-ended tube, and the invention further includes a plug member adpated to be selectively inserted into the tubular male member to urge the catch means outwardly into such operative engagement with the base member second surface. Preferably, the base and support members are hollow and formed of a suitable plastic, such as polyethylene, by a conventional blow molding technique.

Accordingly, one general object of the present invention is to provide an improved footstool.

Another general object is to provide an improved means of effectively joining a supportive member to a footstool base member.

Another general object is to provide an improved hollow plastic footstool which may be conveniently formed by blow molding.

There and other objects and advantages will become apparent from the foregoing and ongoing description, the drawings, and the appended claims.

BRIEF DESCRIPTION OF THE DRAWINGS

FIG. 5 is a fragmentary vertical sectional view thereof, taken generally on line 5—5 of FIG. 4, this view particularly showing the plug member received in the tubular male member, and the hook-like catch means operatively engaging the base member.

DESCRIPTION OF THE PREFERRED EMBODIMENTS

Figure 1:
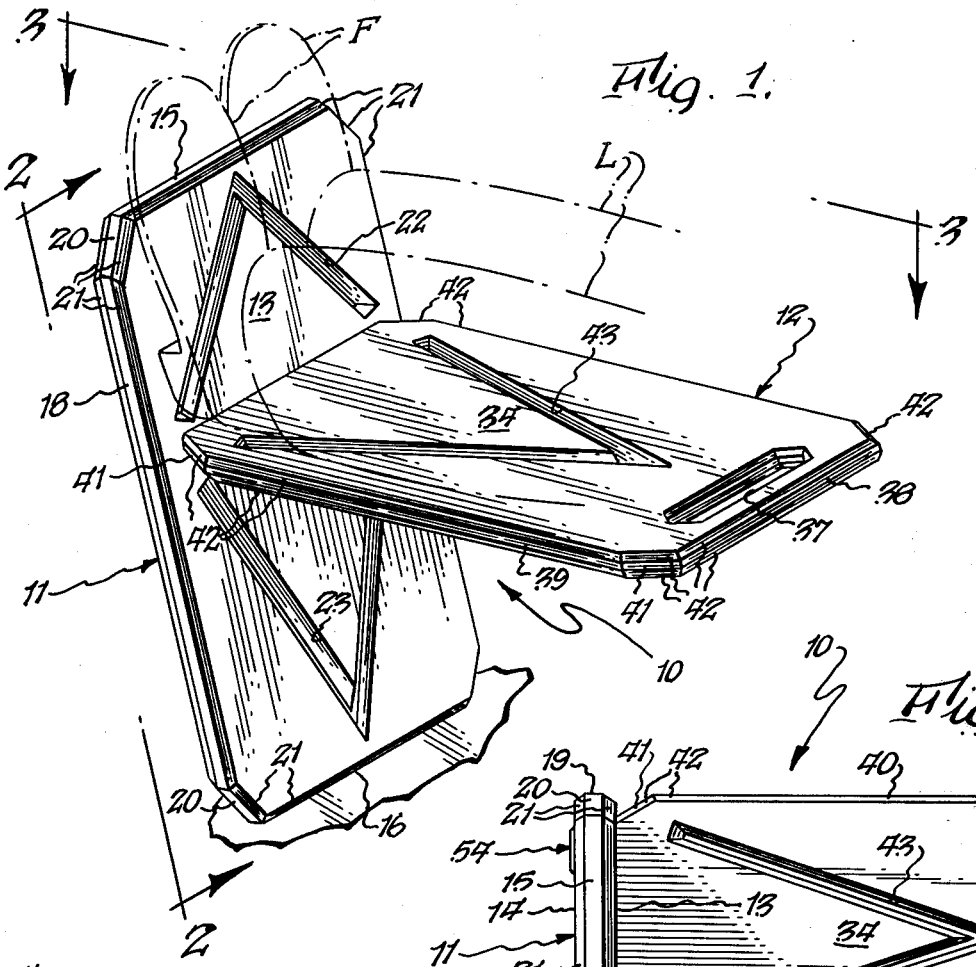
FIG. 1 is a perspective view of one preferred embodiment of the inventive footstool in an operative position to support the legs and feet (shown in phantom) of a user.

At the outset, it should be clearly understood that like reference numerals are intended to identify the same elements and/or structure consistently throughout the several drawing figures, as such elements and/or structure may be further described or explained by the entire written specification of which this detailed description is an integral part.

Figure 3:
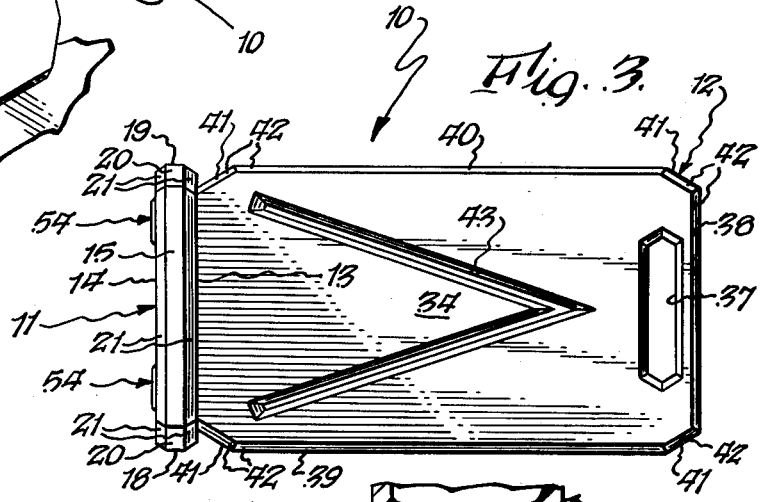
FIG. 3 is a top plan view thereof, this view being taken generally on line 3—3 of FIG. 1.
Figure 2:
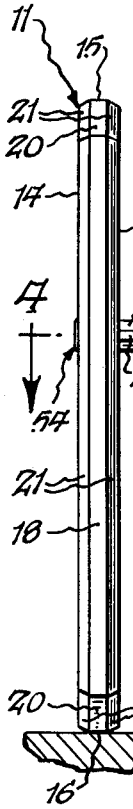
FIG. 2 is a left side elevation thereof, this view being taken generally on line 2—2 of FIG. 1.

Referring now to the several drawing figures, and more particularly to FIGS. 1–3 thereof, the present invention provides an improved footstool, generally indicated at 10, which is adapted to comfortably support one or both legs L and feet F of a person using the same, one operative position of this footstool being shown in FIG. 1.

The improved footstool 10 is shown as broadly including a base member, generally indicated at 11, and a support member, generally indicated at 12, mounted on the base member and extending outwardly therefrom.

The base member 11 is a substantially hollow rectangular plate-like member formed of a suitable plastic material, such as polyethylene or the like, by a conventional blow molding technique. This base member 11 is shown as having a substantially-rectangular planar vertical right face 13, a substantially-rectangular planar vertical left face 14, a horizontal upper surface 15, a horizontal lower surface 16 arranged to engage a floor or some other suitable supportive object, a vertical left side surface 18, a vertical right side surface 19, four diagonal corner surfaces 20, and beveled surfaces 21 communicating the right and left planar surfaces 13, 14 with the peripheral surfaces 15, 16, 18, 19 and 20.

This base member is shown as further provided with a pair of upwardly and downwardly pointed V-shaped grooves or recesses 22, 23, which extend into the base member from the left and right faces 13, 14 thereof (FIG. 5) provide reinforcement for the hollow wall portions of the base member.

Figure 4:
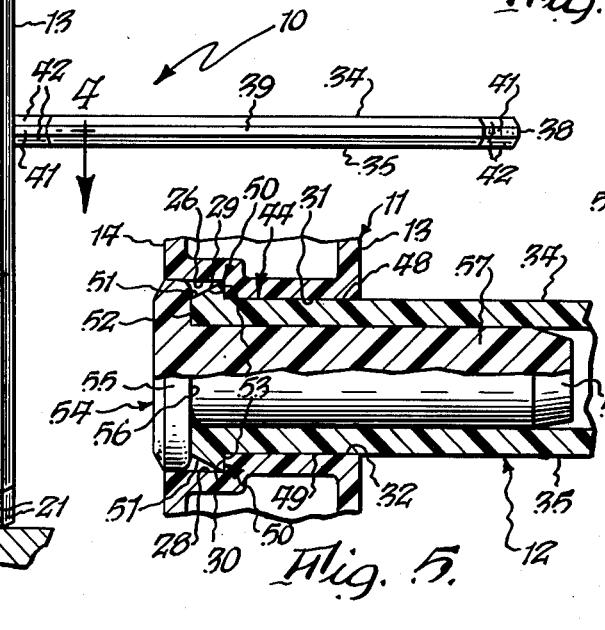
FIG. 4 is an enlarged fragmentary horizontal sectional view thereof, taken generally on line 4—4 of FIG. 2, this view showing the male member, the catch means, and the reinforcing grooves provided in the base member.
Figure 4:
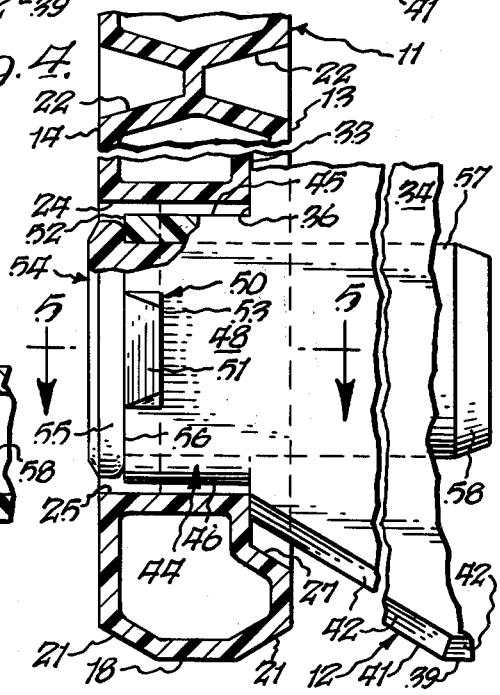

Moreover, as best shown in FIGS. 4 and 5, the base member 11 is provided with two horizontal through openings communicating planar surfaces 13, 14. Each opening is shown as being bounded by right and left rectangular vertical side surfaces 24, 25; and by stepped upper and lower surfaces which include, from left to right in FIG. 5, rectangular upper and lower horizontal surfaces 26, 28 leftwardly-facing rectangular upper and lower vertical surfaces 29, 30, and rectangular upper and lower horizontal surfaces 31, 32 continuing rightwardly therefrom. At their rightward ends, surfaces 24, 25 join a perpendicular transversely-extending vertical surface 33 which joins beveled surface 27 communicating with right planar surface 13. In the embodiment illustrated and described, two of these openings are provided through the base member, although a larger number could alternatively be provided.

The support member 12 is also a substantially hollow rectangular plate-like member formed of a suitable plastic material, such as polyethylene or the like, by a conventional and well known blow molding technique. This support member is shown as having a substantially rectangular planar horizontal upper surface 34, an opposite substantially rectangular planar horizontal lower surface 35, a vertical end surface 36 arranged proximate the base member, an opposite vertical distal end surface 38, a vertical left side surface 39, a vertical right side surface 40, four diagonal corner surfaces 41, and beveled surfaces 42 communicating the upper and lower planar surfaces 34, 35 with the peripheral surfaces 36, 38, 39, 40 and 41. As best shown in FIGS. 1 and 3, an opening 37 is provided through the support member adjacent distal end surface 38 to provide a handle therebetween for ease in carrying the inventive footstool.

Moreover, this support member 12 is shown as further provided with a rightwardly-pointed V-shaped groove or recess 43 which extends downwardly into the support member from its upper planar surface 34. As with the V-shaped grooves provided in the base member, previously described, a similarly configured recess (not shown) extends upwardly into the support member from its lower planar surface 35 to provide means for reinforcing the walls of this hollow support member.

This support member 12 is also provided with at least one male member, generally indicated at 44, which extends leftwardly from support member 36. Adverting now to FIGS. 4 and 5, this male member 44 is shown as being an open ended rectangular tubular member formed integrally with the support member, and includes a right vertical side surface 45 arranged to face base member surface 24, a left vertical side surface 46 arranged to face base member surface 25, an upper hozizontal surface 48 arranged to face base member upper surface 31, and a lower horizontal surface 49 arranged to face base member horizontal surface 32. Moreover, this male member 44 is depicted as carrying a pair of upper and lower catch means 50, 50 arranged to operatively engage base member surfaces 29, 30, respectively. Each of these catch means 50, 50 is shown as being a hook-like member formed integrally with the male member 44 and bonded by an outwardly inclined surface 51 extending rightwardly from male member left end face 52, and a rectangular vertical surface 53 arranged to abuttingly engage base member shoulder surfaces 29, 30. The catch means 50, 50 prevent unintended separation of the male members 44 from the openings provided through the base member.

If desired, the inventive footstool 10 may further include one or more plug members, generally indicated at 54, which are severally adapted to be inserted into the open end of the tubular male member 44 to urge the catch means 50, 50 to move outwardly into engagement with the base member surfaces 29, 30. As best shown in FIGS. 4 and 5, this plug member 54 may include a head portion 55 having a rightwardly-facing vertical surface 56 arranged to abut male member left surface 52, a solid shank portion 57 configured complementarily to the inside tubular shape of the male member, and a rightward tapered nose portion 58. Thus, to assemble the footstool 10, the male members 44 are simply inserted into the openings provided through the base member 11, it being appreciated that the catch means inclined surfaces 51 will cause permissive deformation of the male members until the catch means snaps outwardly such that catch means surfaces 53, 53 will abuttingly engage base member surfaces 29, 30. Thereafter, the plug member 54 may be inserted into the male member 44 to maintain the operative engagement between catch means surfaces 53, 53 with base member surfaces 29, 30. In effect, the inserted plug member prevents the deformation of the male member which might otherwise permit separation of the base and support members.

Therefore, in summary, the present invention broadly provides an improved footstool, of which a presently preferred embodiment is generally indicated at 10. This footstool 10 minimally comprises a base member 11 having upper and lower ends 15, 16, at least one of which is adapted to rest on a floor or some other suitable supportive member; a support member 12 having one marginal end portion mounted on the base member at a position between base member ends 15, 16, this support member extending outwardly and preferably perpendicularly from the base member and adpated to support the leg of a user. The base member 11 has at least one, and preferably two, openings therethrough, a first surface 33 arranged to face the support member, and a second surface, 29, or 30, about the opening and spaced from the first surface 33 and arranged to face away from the support member. The support member 12 has at least one male member 44 extending outwardly therefrom and arranged to penetrate the base member opening, a first surface 36 arranged to abut base member first surface 33, and at least one catch means, 50, carried by the male member and having a second surface 53 arranged to operatively engage the base member second surface, 29 or 30, to prevent unintended separation of the support member from the base member.

Of course, it will be appreciated that it is presently preferred to mount the support member on the base member at a position closer to one end 15 thereof than to the other end 16 thereof, so that the footstool may simply be turned over a vary effective height of the support member 12 for the personal comfort of the user.

Therefore, while a preferred embodiment of the present invention has been shown and described, it will be understood by persons skilled in this art that various changes and modifications may be made without departing from the spirit of the invention which is generically defined by the following claims.

What is claimed is:

1. A footstool, comprising:

a base member having upper and lower ends, at least one of said ends being adapted to rest on a floor;

a support member having one marginal end portion mounted on said base member at a position intermediate said upper and lower base member ends, said support member extending outwardly from said base member and adapted to support the leg of a user;

said base member having at least one opening therethrough, a first surface arranged to face toward said support member, and a second surface about said opening spaced from said first surface and arranged to face away from said support member;

said support member having at least one male member configured as an open-ended tube and extending outwardly from said support member and arranged to penetrate said base member opening, having a first surface arranged to abut said base member first surface, and having at least one catch means carried by said male member and arranged to operatively engage said base member second surface to prevent unintended separation of said support member from said base member; and a plug member adpated to be inserted into said tubular male member to urge said catch means outwardly into such operative engagement with said base member second surface.

2. A footstool as set forth in claim 1 wherein said base member is a hollow plastic member.

3. The footstool as set forth in claim 1 wherein said support member is a hollow plastic member.

4. The footstool as set forth in claim 1 wherein each of said base and support members is a hollow plastic member formed of polyethylene.

5. The footstool as set forth in claim 1 wherein said catch means has a surface arranged to abut said base member second surface.

* * * * *